United States Patent [19]

Parquet et al.

[11] 4,015,729

[45] Apr. 5, 1977

[54] AUTOMATIC CONTROL SYSTEM FOR BACKHOE

[75] Inventors: Donald J. Parquet; Carl O. Pedersen, both of Burlington; Robert M. Barton, Davenport, all of Iowa

[73] Assignee: J. I. Case Company, Racine, Wis.

[22] Filed: Jan. 2, 1976

[21] Appl. No.: 646,035

[52] U.S. Cl. ..... 214/138 R; 37/DIG. 1; 91/1; 91/361; 214/762

[51] Int. Cl.[2] ..... E02F 3/32

[58] Field of Search ..... 214/138 R, 762, 763, 214/764, 1 CM; 37/DIG. 1, DIG. 19; 212/39 R, 39 MS, 55; 91/1, 363 R, 363 A, 364, 361; 340/267 C

[56] References Cited

UNITED STATES PATENTS

| | | | |
|---|---|---|---|
| 3,339,763 | 9/1967 | Caywood et al. | 214/138 R |
| 3,915,325 | 10/1975 | Lark et al. | 214/764 |
| 3,950,687 | 4/1976 | Watson, Jr. | 91/363 A |

*Primary Examiner*—Robert J. Spar
*Assistant Examiner*—Ross Weaver
*Attorney, Agent, or Firm*—Dressler, Goldsmith, Clement, Gordon & Shore, Ltd.

[57] ABSTRACT

An automatic control system for a backhoe utilizing a bucket at the end of a rigid boom is disclosed herein. The automatic control system includes an actuator cooperating with a control valve that controls the flow of fluid to hydraulic rams that pivot the boom. The control system also includes position indicating means between the boom and the frame and a manually settable control element both of which produce output signals that are combined and activate the actuator so that the implement is moved at a rate which corresponds to the differences between the respective signals.

7 Claims, 3 Drawing Figures

AUTOMATIC CONTROL SYSTEM FOR BACKHOE

BACKGROUND OF THE INVENTION

The present invention relates generally to material handling implements, and more specifically to an improved control system for automatically positioning the boom of a material handling implement at a desired angular position with respect to the frame.

Backhoe units presently in commercial use include an articulated boom that is pivoted about a vertical pivot axis on a vehicle. The boom is usually pivoted on the vehicle by fluid rams and the outer end of the boom has a bucket supported thereon that is pivoted by a further fluid ram.

Hydraulically operated backhoes of the above type require constant attention of the operator to perform the various functions. For example, in a normal trenching operation, the operator must continually position the attitude of the bucket with respect to the trench and perform the digging operation by the manipulation of several manually actuated control valves. After the bucket has been filled, the operator must then raise the bucket above ground level and pivot the boom with respect to the frame so that the bucket can be dumped in a position adjacent the trench. In such an operation, the operator must continuously operate numerous levers to carry out the necessary sequence of operation. Throughout each step of the digging process, the operator must make continual decisions as to the necessary attitudes and movements of the components of the backhoe and actuate control valves at the appropriate time to direct the digging and dumping cycles. For these reasons, considerable time is required to train a skillful backhoe operator. Even after the skill is acquired, the work is demanding and tiring, requiring continuous mental and physical alertness to maintain maximum digging rates.

In recent years numerous proposals have been made for automating various portions of a cycle of operation for a backhoe. For example, Caywood et al. U.S. Pat. Nos. 3,339,763 and 3,414,146 disclose completely hydraulic circuits that will function to automatically perform certain functions of a backhoe cycling operation in response to pressure changes in the various fluid motors that are utilized to manipulate the boom and the bucket. One of the problems with control systems of this type is that they are extremely complicated in nature. Furthermore, the flexibility of the operations that can be performed is extremely restricted since there is very little provision for changing the parameters of the automatic control cycle.

More recently, it has been proposed to utilize electric control systems for actuating the swing control valve in a backhoe unit. This type of system is disclosed in Carlson et al. U.S. Pat. No. 3,698,580. While this type of system utilizes an electrical circuit for controlling the position of the boom with respect to the vehicle, such a system has an inherent shortcoming in that it requires the operator to set the desired position for the swing tower, each time it is to be moved.

SUMMARY OF THE INVENTION

According to the present invention, there is provided a control system for a hydraulic motor actuated material handling implement pivoted on a frame. The automatic control system can be set at a desired angular orientation of the implement with respect to the frame and the implement can repeatedly be automatically moved to that position by actuation of a control button.

More specifically, the automatic control means or position setting means includes an actuator that has an output connected directly to a valve spool of a control valve that is utilized to control the flow of fluid to and from the hydraulic motor. The improved position setting means consists of a position indicating means between the frame and the implement which produces an implement output signal having a value which is the function of the angular position of the implement on the frame. A control box receives this signal and also has a manually settable control element that can be set at any desired setting and produces a control signal having a value which is the function of the desired angular setting of the implement with respect to the frame. The two signals are then combined in the control box or control means and an output signal is produced and supplied to the actuating element of the actuator with the signal having a value that is proportionate to the differences between the implement output signal and the control signal to activate the actuator and move the implement at a rate which corresponds to the output signal.

More specifically, the control means has a manually settable control element which can be set to define two fixed angular positions for the boom with respect to the frame within an arcuate range of approximately 180 degrees. Once the two settings have been made, the operator need only press a control button for either of the settings and the implement will automatically be moved to the angular position without any further attention by the operator.

In the particular illustrated embodiment, the manually settable control element is capable of setting two specific angular positions of the implement with respect to the frame, such as the dig and dump positions, and the implement can automatically be moved to the respective positions by actuation of the respective circuits associated therewith. Furthermore, the respective positions can readily be changed merely by manipulation of appropriate elements in the respective control circuits.

In addition, the system also has means for automatically interrupting the operation of the automatic function so that the operator is at all times in complete control of the movement of the unit.

DETAILED DESCRIPTION

Figure 1:
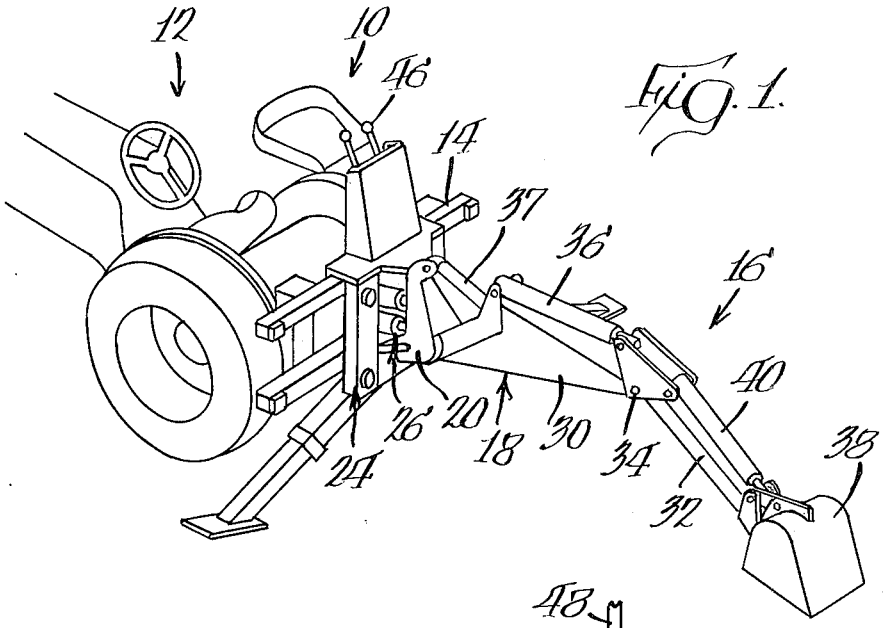
FIG. 1 shows a fragmentary perspective view of a vehicle and a material handling implement that may have the present invention incorporated therein.

While this invention is susceptible of embodiment in many different forms, there is shown in the drawings and will herein be described in detail a preferred embodiment of the invention with the understanding that the present disclosure is to be considered as an exemplification of the principles of the invention and is not intended to limit the invention to the embodiment illustrated.

FIG. 1 of the drawings illustrates a backhoe unit, generally designated by the reference numeral 10, consisting of vehicle 12 having a frame 14 supported on the rear end thereof. A material handling implement 16 is supported on frame 14 for pivotal movement about a vertical pivot axis. More specifically, material handling implement 16 consists of an articulated boom 18 that is pivotally supported about a horizontal pivot axis on a swing tower 20 which in turn is pivoted about a vertical pivot 22 between swing tower 20 and a subframe 24. A pair of fluid rams 26 are interposed between swing tower 20 and frame 24 to produce the pivotal movement. Subframe 24 preferably is transversely shiftable with respect to frame 14 so that the transverse position of swing tower 20 can readily be changed with respect to the vehicle 12.

Material handling implement 16 may take any variety of shapes and in the illustrated embodiment consists of a rigid boom section 30 that is pivoted about a horizontal pivot on swing tower 20 through a fluid ram 37. The outer end of boom section 30 has a dipper stick assembly 32 pivoted about a horizontal pivot 34 and this pivotal movement is accomplished through a second fluid ram 36. The outer end of dipper stick assembly 32 incorporates a bucket 38 that is again pivotally supported about a horizontal pivot and is moved by a fluid ram 40.

As indicated above, during normal operation of backhoe unit 10 in an operation, such as a trenching operation, the boom is generally positioned as indicated in FIG. 1 and a trenching operation is begun. During this operation, bucket 38 is repeatedly filled by manipulation of fluid rams 37, 36 and 40. After the bucket has been filled, the material handling unit 16 is manipulated to position the bucket above ground level and then is pivoted about vertical pivot 22 through actuation of fluid rams 26 to transversely shift the bucket with respect to the trench that is being dug. When the boom and buckets reach a desired angular position with respect to the vehicle, the bucket is "dumped" and the implement 16 is returned to a position where it is longitudinally aligned with the trench and the operation is repeated.

In a normal trenching operation, it is customary to have the operator move the implement 16 to the same general angular position with respect to the vehicle in both the trenching position as well as the dumping position. This is desirable in that it is preferable that the dirt which has been removed from the trench be located in close proximity to the trench for subsequent return after the cables or other units have been placed in the trench.

According to the present invention, vehicle 10 incorporates the necessary components which will allow the operator to automatically move the material handling implement 16 to either the trenching position or the dumping position by actuation of control buttons located in the control console for the vehicle. Such an arrangement greatly relieves the operator of the task of careful manipulation of the boom for either the trenching or the dumping operation.

Figure 2:
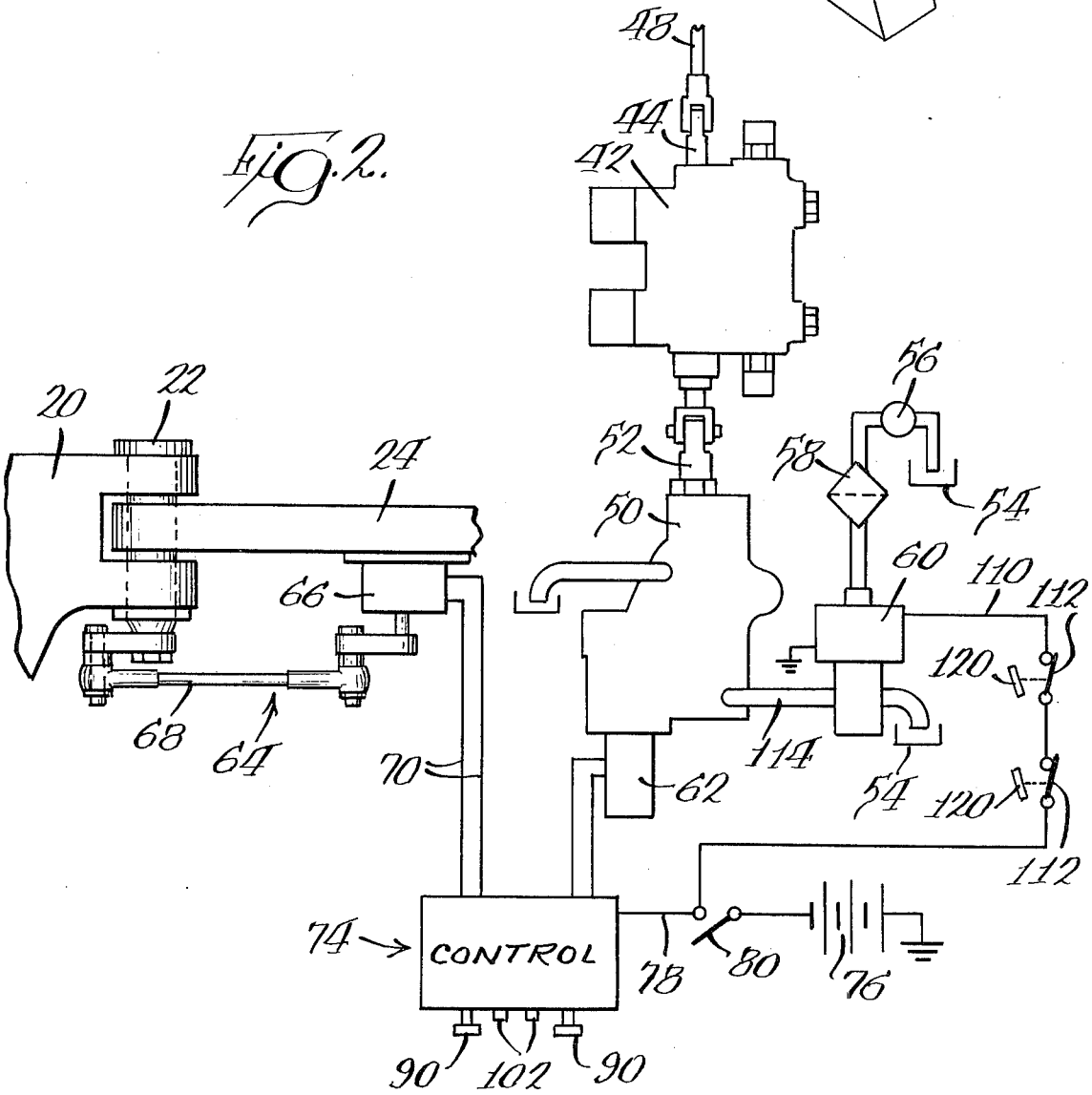
FIG. 2 is a schematic illustration of the components that form the automatic positions setting means.

Referring to FIG. 2 of the drawings, it will be noted that the control system includes a manually actuated control valve 42 that has a valve spool 44 which is movable in opposite directions from a neutral position to supply pressurized fluid from a reservoir to one end of hydraulic rams 26 while connecting the opposite end to the reservoir. Movement of the valve spool in opposite directions from the neutral position is normally accomplished by manipulation of a control lever 46 which is connected to spool 44 through a linkage 48 (only a part of the linkage being shown).

As indicated above, it has been customary for the operator to continuously manipulate control lever 46 to move the implement 16 between trench and dump positions during a trenching operation. However, according to the present invention, vehicle 10 incorporates an automatic control system or position setting means which can be set at any two desired angular positions within an arc of approximately 180° of movement for implement 16 with respect to vehicle 10. After the desired angular settings have been made, it is only necessary for the operator to push a button associated with each of the respective positions, and the material handling implement, more specifically the boom, will automatically move to the desired angular orientation without further attention by the operator. Furthermore, the rate of movement of the implement with respect to the vehicle is proportionate to the amount of movement that is required. Stated another way, the rate of movement of the implement with respect to the vehicle is originally at a maximum rate which progressively decreases as the implement approaches the desired setting to prevent any overtravel and also to prevent abrupt stops which may produce damage to the entire system.

Referring to FIG. 2, the automatic control system or position setting means includes a hydraulic actuator 50 that has an output element 52 connected to valve spool 44. Actuator 50 is a commercially available unit that is sold by Dynex Controls Division of Applied Power Inc., Pewaukee, Wisconsin and is a remote proportional actuator Model No. SA-1205-03-00. Hydraulic fluid under pressure is supplied to actuator 50 from a reservoir 54 and pump 56. The pressurized fluid from source 56 passes through a filter 58 and a solenoid operated valve 60, for a purpose that will be described later.

Basically, actuator 50 has a servo operated pilot spool incorporated therein which is capable of being positioned in opposite directions from a neutral position and the angular position determines the amount of movement of output piston (or element) 52. The position of the pilot spool is controlled by a solenoid valve 62 that forms part of actuator 50 and has a signal supplied thereto as will be described later.

Figure 3:
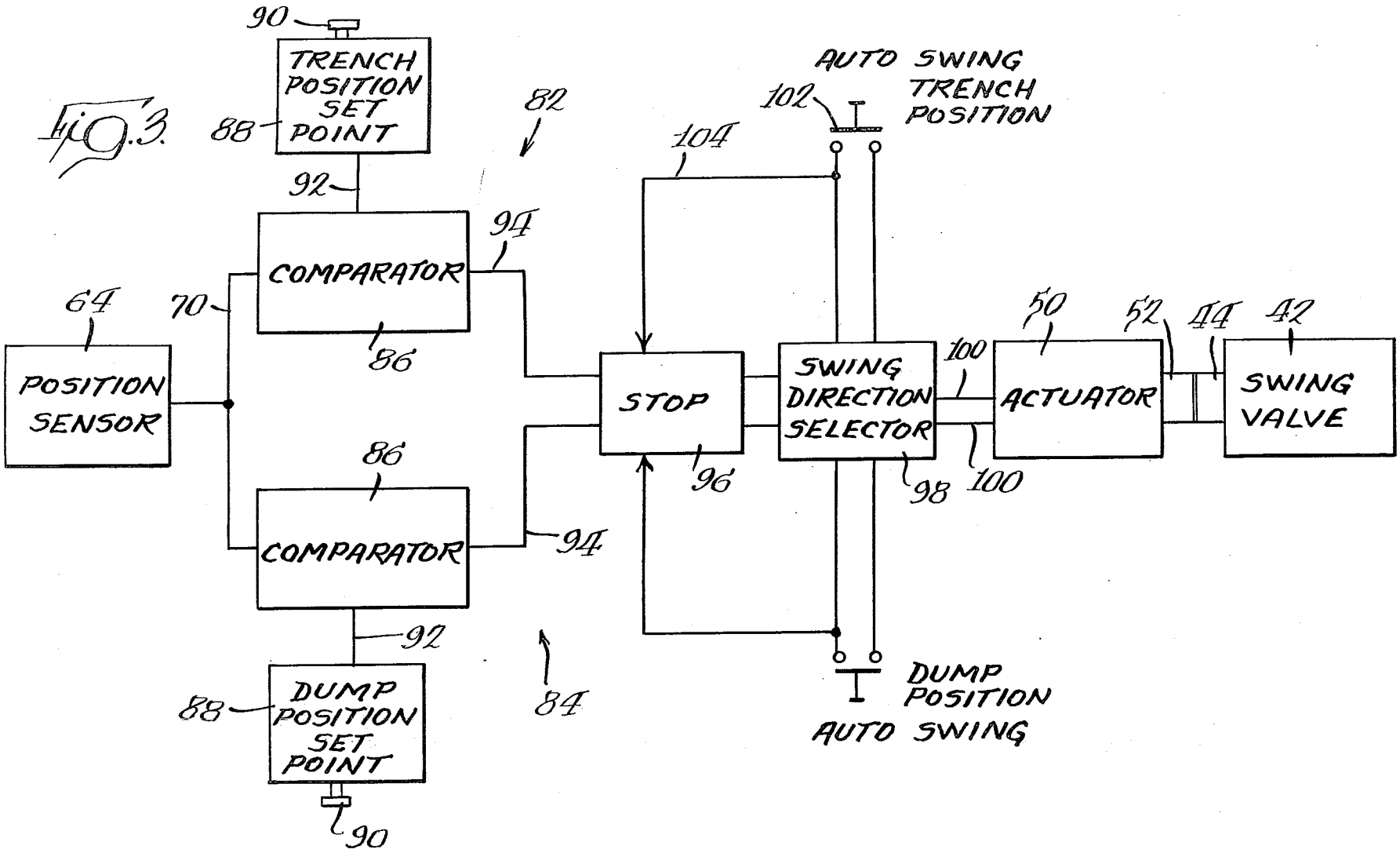
FIG. 3 is a schematic illustration of the circuitry necessary for the automatic position setting means.

The automatic control system or position setting means also incorporates a position indicating means 64 between frame 24 and swing tower 20. More specifically, position indicating means 64 includes a potentiometer 66 that is fixed on frame 24 and has a linkage 68 connecting the input of potentiometer 66 to swing tower 20. Thus, pivotal movement of the swing tower 20 will produce an implement signal through lines 70 that has a value which is the function of the angular position of the implement on the frame. Preferably, this signal is in the form of an electrical resistance that is a function of the position of the implement with respect to the frame. This implement signal through lines 70 is fed to control means 74 which has power supplied therethrough from a source 76 and a line 78 with a manually actuated switch 80 located in line 78. Control means or box 74 is schematically illustrated in FIG. 3 and includes a manually settable control element 88 that is capable of producing a control signal having a value which is the function of the desired angular setting of implement 16 on vehicle frame 12. More specifically, as illustrated in FIG. 3, control means 74 includes first and second electrical circuits 82 and 84 that are independent of each other and each is settable to an infinite number of positions covering an arc of approximately 180 degrees of movement of the implement 16 with respect to vehicle 10. For example, circuit 82 may be utilized to set a predetermined dig position for implement 16 while circuit 84 can be utilized to set a desired dump position for implement 16. Since the two circuits are virtually identical, only one will be described in detail.

Referring to FIG. 3 circuit 82 incorporates a comparator 86 that receives the implement signal from position indicating means 64 through lines 70 and also received a second signal from a manually settable control element 88 which is preferably set by rotation of a control knob 90. Manually settable control element 88 produces an output signal through line 92 that is fed to comparator 86 and this output signal or control signal has a value which is the function of the desired angular setting of the implement on the frame. Comparator 86 then integrates the two signals received through lines 70 and 92 and produces an output signal through line 94 and interrupt circuit 96 to swing direction selector 98. The output of swing direction selector 98 passes through lines 100 to a servo operated pilot spool 62 forming part of actuator 50. Each circuit also includes a momentary contact switch 102 connected to swing direction selector 98 which, when pressed, will activate the control system and cause the implement 16 to move in the desired direction, as will be explained in more detail hereafter. Switch 102 is also connected to the interrupt or stop circuit 96 through line 104.

Before describing the operation of the system, the remainder of the circuit will now be described. As indicated above, the pressurized fluid source leading to actuator 50 has a solenoid operated valve 60 located therein. Solenoid operated valve 60 is normally held in an open position by supplying power from source 76 through line 110 which has normally closed switches 112 therein. In this position, pressurized fluid source 56 is connected directly to actuator 50 through conduit 114. If, however, for any reason, the operator needs to momentarily gain control of the movement of the implement after an automatic cycle has been started, it is only necessary for him to open one of the two switches 112 which will automatically interrupt current flow to solenoid valve 60 and will cause valve 60 to shift so that the actuator conduit 114 is connected to reservoir 54. Preferably, switches are actuated by foot pedals 120 so that the operator may interrupt the circuit using either foot and at the same time start manipulating implement 16 by the use of control lever 46.

One of the significant features of the present invention is the fact that the amount of movement of the valve spool 44 is a direct function of the magnitude of the signals that are supplied to actuator 50 so that the implement is moved at a rate which corresponds to the magnitude of the signal. The magnitude of the signal gradually decreases as the final point for the boom is reached, which results in a movement of valve spool 44 so that the implement is gradually decelerated rather than abruptly shut off which will prevent stresses and vibration in the overall system.

In the particular embodiment illustrated, the output signal from the position indicating means 64 consists of an electrical resistance that is the function of the position of the implement on the vehicle. Also, the two manually settable control elements 88 likewise are in the form of a variable resistor that produces an electric resistance which is fed to comparator 86. These two electrical resistances are combined and produce a control or output signal that is in the form of a bi-polar D-C voltage which has a positive value for moving the implement in one direction and a negative value for moving the implement in the opposite direction. Also, the magnitude of the voltage determines the rate of movement of the implement.

Summarizing the above, the present invention provides a simple unique system for readily allowing the operator to repeatedly reposition the implement at an exact desired angular orientation with respect to the vehicle 12. More specifically, the system provides the operator with two position set point controls that are independent of each other and are settable over an arc of approximately 180°. Once the points have been selected and set, the operator can readily automatically move the implement to either to the two set points by merely pressing one of two buttons 102 which actuates momentary switches that will activate the system and cause the boom to swing to the set position.

What is claimed is:

1. In a vehicle having a frame and a material handling implement pivoted about a pivot axis on said frame by hydraulic motor means with a reservoir and pressurized fluid source connected to said motor means through a control valve having a valve spool movable in opposite directions from a neutral position to actuate said motor means, and a position setting means for automatically setting the position of said implement with respect to said frame, the improvement of said position setting means comprising an actuator having an output connected directly to said valve spool with said pressurized fluid source connected to said actuator, an actuating element for activating said actuator, a position indicating means between said frame and implement, said position indicating means having an implement signal having a value which is the function of the angular position of said implement on said frame, control means for receiving said implement signal, said control means having a manually settable control element producing a control signal having a value which is the function of the desired angular setting of said implement on said frame, said control means producing an output signal supplied to said actuating element and having a value which is proportionate to the difference between said implement signal and said control signal to activate said actuator and move said implement at a rate which is proportional to the valve of said output signal.

2. A vehicle as defined in claim 1, in which said manually settable control element has first and second settings respectively defining first and second positions for said implement on said vehicle.

3. A vehicle as defined in claim 1, further including manual override means cooperating said actuator for interrupting the operation of said actuator.

4. A vehicle as defined in claim 3, in which said override means includes a solenoid operated valve between said pressurized fluid source and said actuator for interrupting flow to said actuator and draining pressurized fluid from said actuator.

5. A vehicle as defined in claim 1, in which said position indicating means is a potentiometer that produces an electric resistance that is a function of the position of said implement, said manually settable control element is a variable resistor producing an electric resistance and said control signal is a bi-polar D-C voltage which has a positive value for moving said implement in one direction and a negative value for moving said implement in the opposite direction and in which the magnitude of said voltage determines the rate of movement of said implement.

6. A vehicle as defined in claim 1, in which said position setting means includes a first circuit having a first manually settable control element therein and receiving said implement signal, and a second circuit having a manually settable control element therein and receiving said implement signal, said first and second circuits each having switch means therein for activating the respective circuits so that two desired angular positions can be selected for said implement and the implement can be repeatedly moved to the respective positions by the actuation of the respective switch means.

7. A vehicle as defined in claim 6, further including means in each circuit for interrupting the respective circuits to stop said implement.

* * * * *